US006248051B1

(12) United States Patent
Bellanca

(10) Patent No.: US 6,248,051 B1
(45) **Date of Patent: *Jun. 19, 2001**

(54) APPARATUS, SIGNATURE AND METHOD OF FOLDING SINGLE OR MULTIPLE SHEET AND WEB SIGNATURES FOR USE IN BOOKBINDING

(75) Inventor: Joseph V. Bellanca, Sarasota, FL (US)

(73) Assignee: Joseph Bellanca Revocable Trust, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/349,370

(22) Filed: Jul. 8, 1999

Related U.S. Application Data

(63) Continuation of application No. 08/998,215, filed on Dec. 24, 1997, now Pat. No. 5,976,065.

(51) Int. Cl.[7] ..... B05C 1/16; B05C 11/04; B05C 1/04

(52) U.S. Cl. ..... 493/334; 493/333; 493/325; 493/347; 493/393; 493/351

(58) Field of Search ..... 493/357, 333, 493/334, 325, 393, 347, 151; 156/253, 252, 442.1, 442.2, 305, 308.8

(56) References Cited

U.S. PATENT DOCUMENTS

| | | | | |
|---|---|---|---|---|
| 1,543,354 | * | 6/1925 | Zacher | 493/333 |
| 3,592,712 | * | 7/1971 | Greason | 493/334 |
| 3,839,118 | * | 10/1974 | Sparks | 493/334 |
| 4,262,939 | * | 4/1981 | Schoettle, Jr. | 493/325 |
| 5,071,555 | * | 12/1991 | Enbom | 493/333 |
| 5,655,866 | * | 8/1997 | Bellanca | 493/357 |
| 5,807,226 | * | 9/1998 | Lani Bradley | 493/334 |

* cited by examiner

*Primary Examiner*—Eugene Kim
(74) *Attorney, Agent, or Firm*—Charles J. Prescott

(57) ABSTRACT

An apparatus and method for making improved folded signature for subsequent use in gathering and combining or binding in bookbinding. Each folded signature includes uniquely positioned perforated folds, sequences of folding and adhered together perforated folded edges which reduce folding time, alter folded signature orientation during gathering, eliminate the need for having a conventional backbone, and provide a binding or pulling edge.

4 Claims, 4 Drawing Sheets

APPARATUS, SIGNATURE AND METHOD OF FOLDING SINGLE OR MULTIPLE SHEET AND WEB SIGNATURES FOR USE IN BOOKBINDING

This is a continuation application of Ser. No. 08/998,215, filed Dec. 24, 1997 now U.S. Pat. No. 5,976,065.

BACKGROUND OF THE INVENTION

1. Scope of Invention

This invention generally relates to bookbinding and more particularly to a uniquely configured signature, method of folding, and apparatus for folding thereof which increases bookbinding efficiency.

2. Prior Art

Sequentially paged products such as books, pamphlets and magazines derive their origin of manufacture from ancient times, even before movable type, when calligraphic art and hand illuminating art were used by monks to tediously reproduce manuscript pages. The term "signature" is derived from the fact that the calligrapher and hand illuminator of a "quad", a single large sheet containing four to eight pages, identified his work by signing his name to the full sheet containing these pages. Therefore, the original building block of sequential page order still in use is the signature or the process of folding large sheets of paper containing pages into smaller, manageable units so that each page is held in a desired sequential order until bound together.

After the signature-in-the-flat has been completed, they are passed to a folding machine in which the large sheets are folded halfway down their length a number of times until the correct page size for the book and the correct sequence of page numbering is obtained. Thereafter, the folded signatures are placed in receiving hoppers of collating machines or gatherers and are withdrawn one at a time from each of as many hoppers as there are separate signatures in the book. Thus, from each hopper, one signature at a time is withdrawn from the bottom of each stack of signatures in each hopper and deposited on a traveling belt which then moves each signature along to the next hopper where the next signature is deposited on the first and so forth.

By conventional signature folding, this structure affords two important elements, both in the form of what is called the backbone or binding side. The backbone is first used for its multiple layer folded page strength to withdraw each signature one at a time from the bottom of the signature stack within each hopper. The backbone is then utilized to bind the signatures together to form the book.

Three separate methods of combining or binding the signatures together are utilized. The first and most popular method is by simply sewing the stacked signatures together to create combined pages. Another method utilized is "perfect or patent" binding wherein, after gathering, all of the backbones or binding sides are eliminated as by shearing so that the center pages of each signature are exposed. All of the exposed page edges are then joined to each other by applying adhesive thereto. A variation of the perfect or patent binding is entitled "burst binding" in which the folded sheets of each signature have perforations applied to the folded or binding side in an upstream process. These perforations allow certain types of adhesives to penetrate to the center pages. However, this process is limited to certain types of paper and adhesives and is generally limited to certain magazine and catalog productions due to the restrictions on paper, adhesives and drying time. The third method utilizes staples through the backbone in lieu of sewing for relatively small books.

During the signature folding process, each time the sheet must be turned or changed in direction to accommodate a fold orthogonal or perpendicular to the last, the fold speed is reduced considerably. In folding a signature by conventional means as above described, the material must be reoriented for each successive fold. By utilizing the present invention, only one change of direction is required which is estimated to increase press speeds and therefore production by as much as twenty percent (20%).

In addition, the present invention provides for perforations along fold lines in some selected folds so as to completely eliminate the need for a sheering or cutting process of the binding edge prior to effecting gluing thereof in perfect or patent binding. Perforated folds also reduce the size if the signature in the flat for added paper savings.

Downstream operations of each signature assembly require proper orientation so that the background preparation may be completed. This position requires that the folded edge of the assembled signatures normally in the long dimension, be turned to a suitable position for downstream tasks. One type of assembly machine requires that the signatures be reoriented with the backbone facing forwardly in the direction of travel, while other assembly machines require that the gathered signatures be turned or reoriented with the backbone facing rearwardly. My previous U.S. Pat. No. 5,655,866 teaches an improved perforated folded signature. The present invention provides perforated and adhered folds which are adhered together or along either side edge which adapts to either form (web or sheet) of assembly equipment.

By both perforating and adhering multiple webs of preprinted paper material together along at least one of the perforated folds, the multiple webs are stabilized together from relative longitudinal movement therebetween.

BRIEF SUMMARY OF THE INVENTION

This invention is directed to an apparatus and method for making improved folded signature for subsequent use in gathering and combining or binding in bookbinding. The folded signature includes uniquely positioned perforated folds, sequences of folding and adhered perforated folded edges which reduce folding time, alter folded signature orientation during gathering, and eliminate the need for having a conventional backbone.

It is therefore an object of this invention to provide a method of folding a signature which minimizes the need for reorienting after each fold, thus reducing sequential folding time.

It is another object of this invention to provide a method of folding a signature which eliminates the need for sheering the folded backbone or binding side prior to perfect or patent binding which utilizes adhesive.

It is still object of this invention to provide a method of folding a signature which reduces paper waste in bookbinding.

It is yet another object of this invention to provide a uniquely folded signature utilized in bookbinding assembly equipment which orients the binding side in either forwardly or rearwardly direction for use with all existing equipment.

It is yet another object of this invention to provide an improved signature for use in bookbinding.

It is still another object of this invention to provide an apparatus which perforates, adheres and prefolds continuous multi-layer webs of preprinted paper which become folded signatures in subsequent operation and which, by adhesion, prevents the multiple web from relative longitudinal movement once the web leaves the prefolder apparatus.

In accordance with these and other objects which will become apparent hereinafter, the instant invention will now be described with reference to the accompanying drawings.

DETAILED DESCRIPTION OF THE INVENTION

Figure 1:
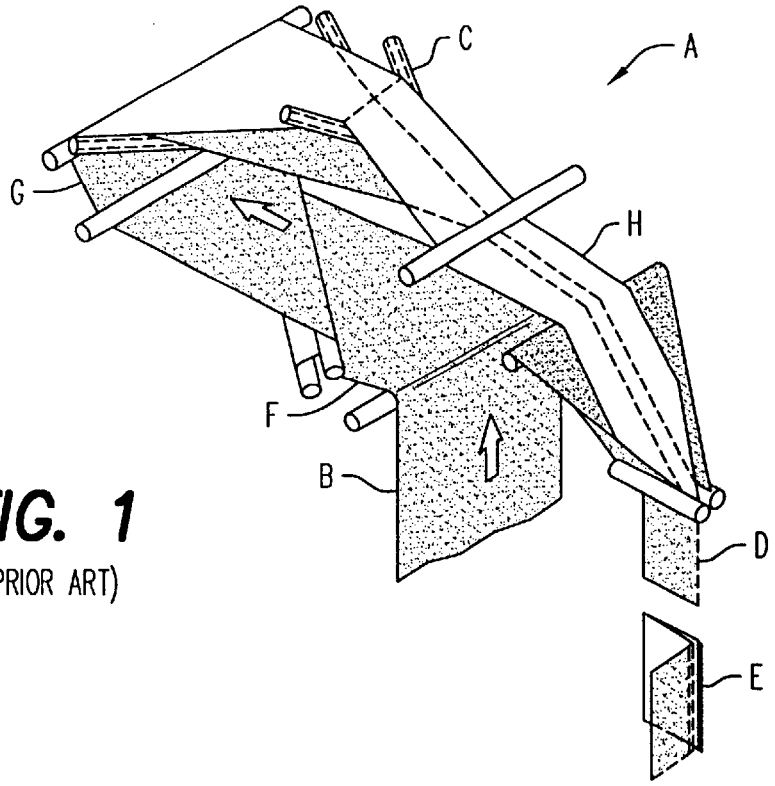
FIG. 1 (PRIOR ART)
FIG. 1 is a perspective view of conventional continuous web prefolder apparatus.
Figure 2:
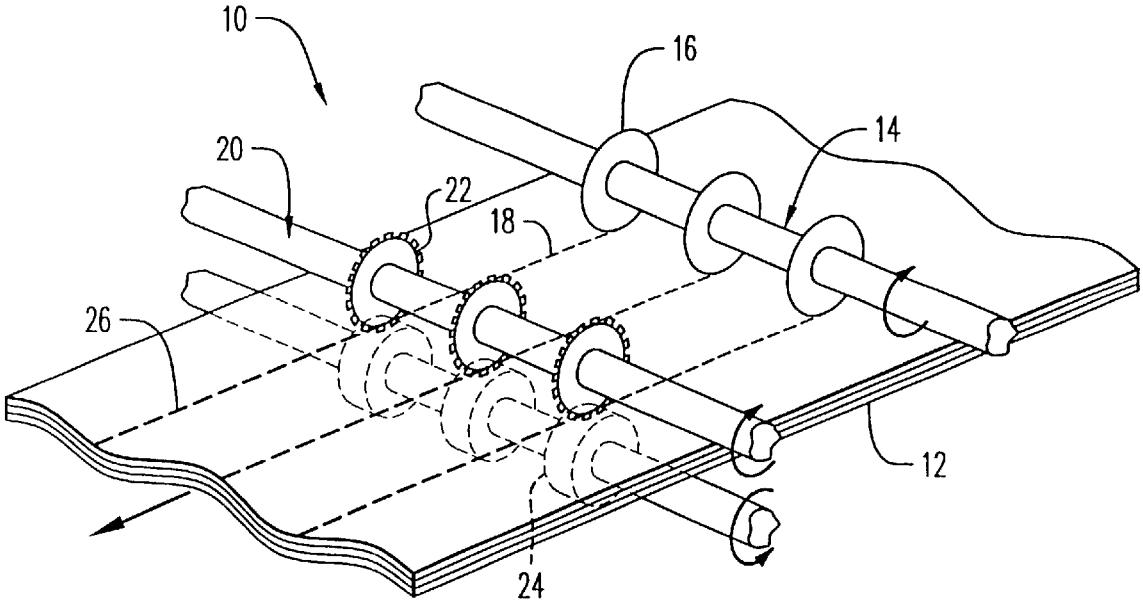
FIG. 2 is a perspective schematic view of the preferred apparatus and method of the invention.
Figure 3:
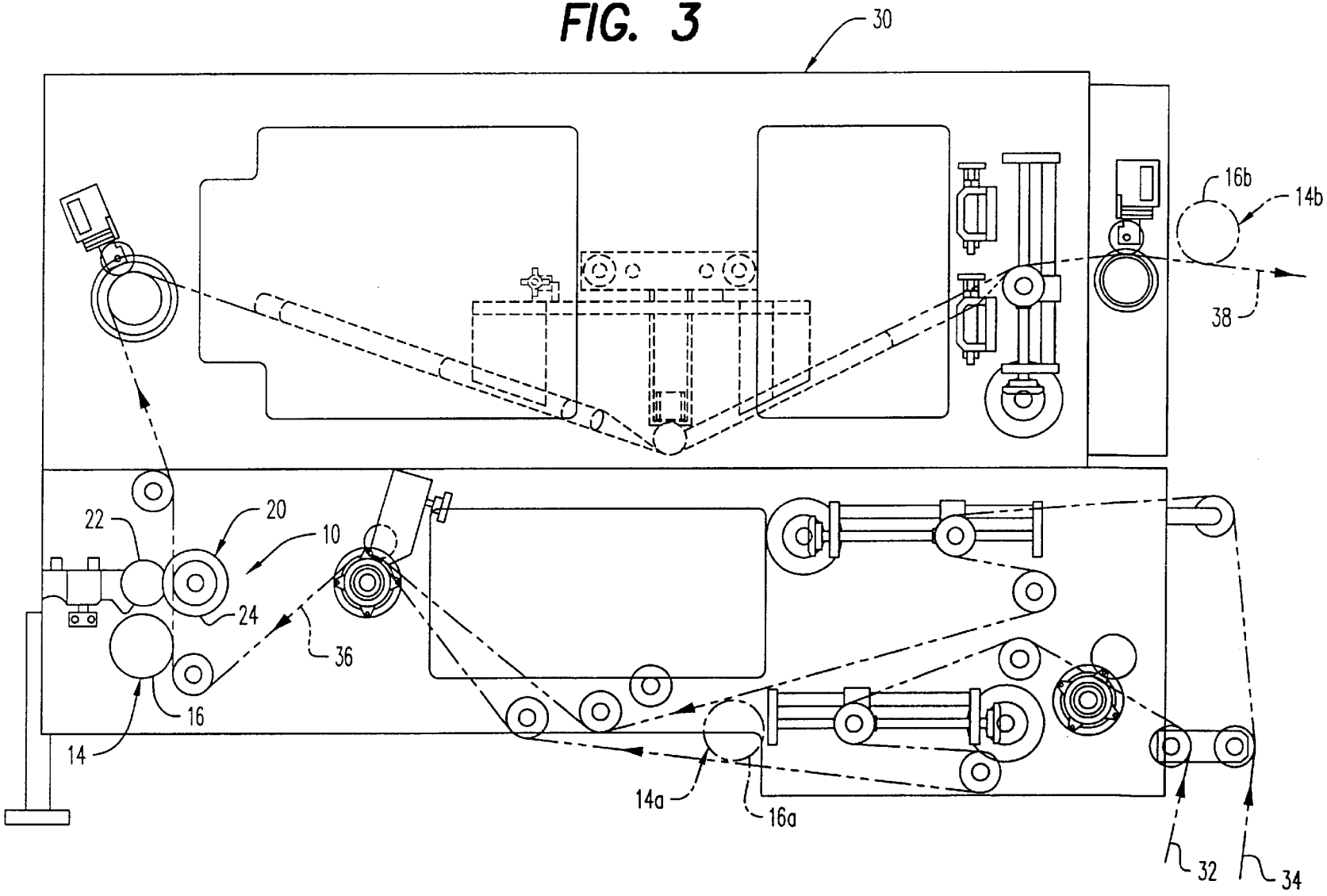
FIG. 3 is a simplified side elevation view of a conventional web prefolder which includes the invention of FIG. 2 in alternate positions.

Techniques and equipment utilized in conventional signature folding, gathering and binding apparatus are shown in FIGS. 1 to 3 of my prior U.S. Pat. No. 5,655,866 which is incorporated by reference.

Referring now to the drawings, a simplified perspective view of a conventional prefolding machine or apparatus is shown generally at numeral A in FIG. 1. Such a prefolding apparatus is currently available from VITS-America, Inc. This apparatus A is used to begin the folding process of a continuously fed web of preprinted paper stock which, when fully folded and cut to length, produces a fully folded signature E. The web of paper B moving in the direction of the arrows is brought into a partially folded position by guides or folding arms C, discharging in the prefolded configuration at D.

In FIG. 3, the apparatus of the improved prefolding apparatus of the present invention is shown generally at numeral 30 and generally embodies the prefolding orientation and features of the prior art prefolder described in FIG. 1. The preferred embodiment of the perforating and wetting apparatus of the present invention shown generally at numeral 10 in FIG. 2, at G in FIG. 1, and is shown in position in FIG. 3 as well. This apparatus 10 includes a web wetting stage 14 including a plurality of water distribution wheels 16 each of which dispose a fine line or lined region 18 of water or other wetting agent longitudinally along the length of the multiple web bundle 12 as it moves through the apparatus 10.

Adjacent to the wetting stage 14 is a perforating apparatus shown generally at numeral 20. A plurality of perforating discs 22 positioned on the upper side of the multiple layer web 12 interact with appropriately formed apertures in aligned and synchromoniously rotating perforating hubs 24 positioned below the web 12. The lateral or side-to-side alignment of these perforation wheels 22 generally align with the wetted fold lines 18 so that the longitudinal perforations 26 are in substantial alignment and registry with the wetted fold lines 18 as previously described.

By the arrangement of the apparatus 10 of FIG. 2, a multiple layer of web 14 is both perforated to define a fold line longitudinally thereto in spaced relationship as shown, along with being wetted along each of the perforation lines to effect a bonding or gluing of the multiple webs together to prevent any further longitudinal relative movement therebetween.

The majority of the web paper stock utilized in web printing of signatures includes a coating surface of casein or clay applied to the surface of the paper. This coating provides a shiny surface for enhanced durability and appearance. When the lines of moisture or wetting agent are applied as previously described, this surface coating becomes somewhat adhesive so that, when dried, the bonding along those wetted lines is substantially permanent. Details of the alternate positioning of this wetting line across the width of the web will be described herebelow. As an alternative to the self-adhesive nature of these coated web paper stock materials, a separate gluing agent may be applied to accomplish the same purpose and is envisioned within the scope of this invention.

Two alternative locations for the wetting apparatus 14 are shown in phantom at 14*a* and 14*b* and at F and H locations in FIG. 1. Thus, the wetting wheels 16*a* and 16*b* may be disposed either prior to the combining of the multiple web bundle in FIG. 2 at 16*a* or just prior to the discharge of the web 38 in its prefolded orientation at 16*b*. This wetting agent may also be applied just prior to or during the final folding operations subsequent to the web bundle entering the folder apparatus (not shown).

Figure 4:
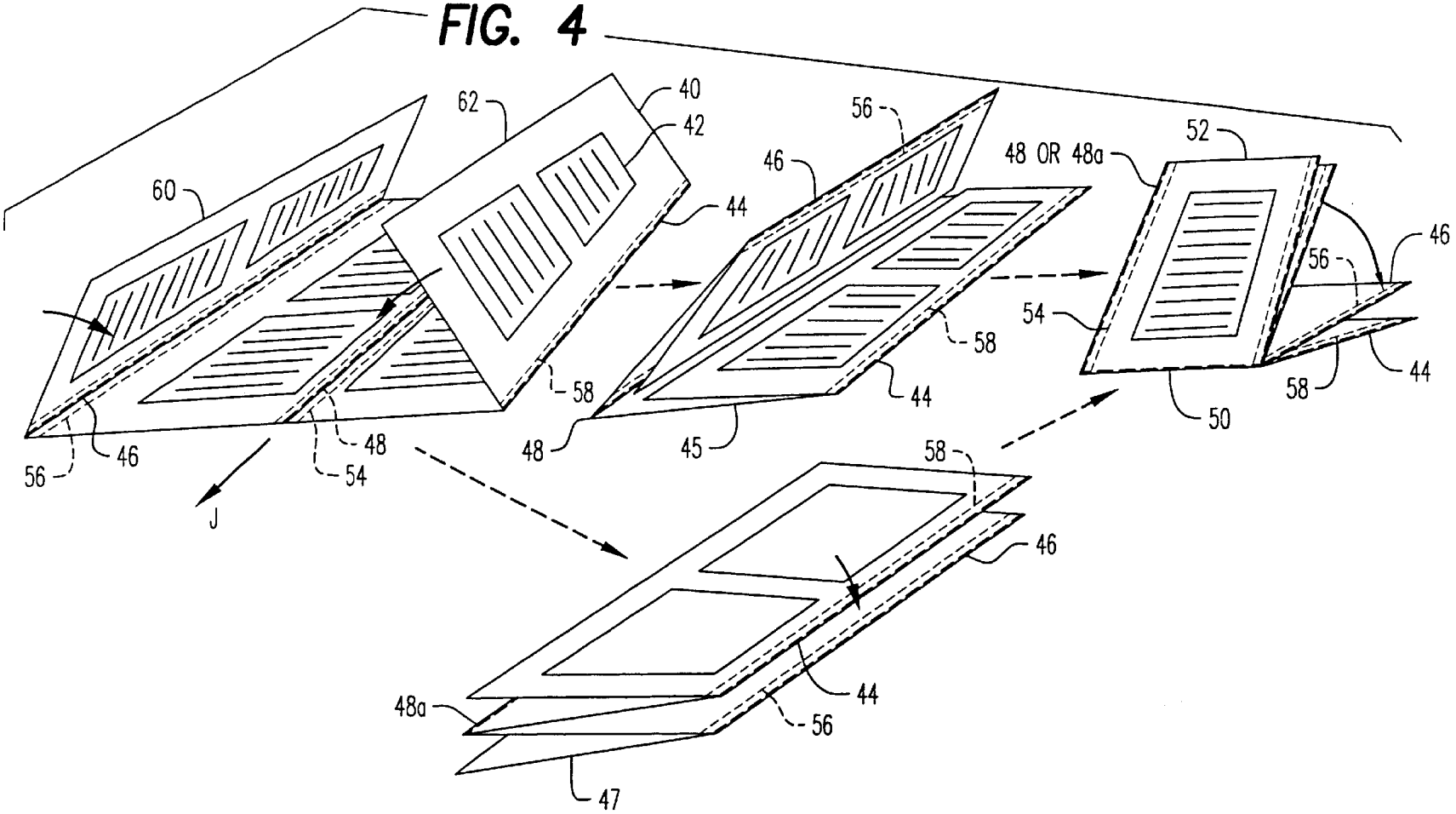
FIG. 4 is a perspective view showing the preferred signature folding sequence of the present invention.

Referring now to FIG. 4, an improved folded signature 52 and the method of folding, perforating and adhering same from sheet or web stock are there depicted. The signature in-the-flat, moving in the direction of arrow J within the folding machine 10 of FIG. 1 of the '866 patent, is initially folded along fold lines 44 and 46 which are transversely oriented to the length of the signature at 40 and spaced one quarter of the overall length of the signature from each end thereof to define a twice folded signature 40. Thereafter, the signature at 40 is folded again about fold line 48 transversely oriented and centrally positioned from each end of the signature in-the-flat. This produces a three-times folded signature 45 or 47. Lastly, the signature is folded into its final form at 52 by folding along fold line 50 positioned halfway between the length of the three-times folded signature 45 or 47. Preferably, the twice-folded signature 40 is folded about fold line 48*a* in the opposite direction to produce three-times folded signature 47. Note that the signatures at 45 and 47 only need to be rotated through 90° once as the first three folds at 44, 46 and 48 are parallel to one another. Note further that in some situations, the fully folded signatures 45 or 47 require only the three folds at 44, 46 and 48 (a or b) and are fully folded at this stage.

In the preferred embodiment of the invention shown in FIG. 4 resulting in the fully folded signature 52, all of the fold lines 44, 46, 48, 48*a* and 50 are perforated as well. The primary objective of the perforations along these folds is to produce a side binding edge 48 or 44/46 which eliminates the need for further preparation in accomplishing a glued perfect or patent-bound edge. The perforations allow adhesive penetration in conjunction with specific paper types. However, where folding equipment may be selectively structured, only one former fold 48 or 44/46 need be perforated, that being the fold which will form the to-be-glued biding edge.

In addition to forming the perforation along margins 44, 46 and 48 as shown in FIG. 4 and as previously described, the present invention includes the application of a wetting or gluing agent along one or more of these same perforated folding margins shown at 54, 56 and 58. The folded signature embodiment 47 is preferred with respect to the effectiveness of the wetting or gluing agent along these perforated and folded margins. Note that this embodiment 47 provides enhanced versatility and advantage both in its four folded form 52 wherein the transverse fold 50 is effected, as well as in the form of a three folded signature 45 or 47 without making fold 50. In many cases in book binding, the signature need only be folded three times along perforated folds 44, 46 and 48.

Figure 5A:
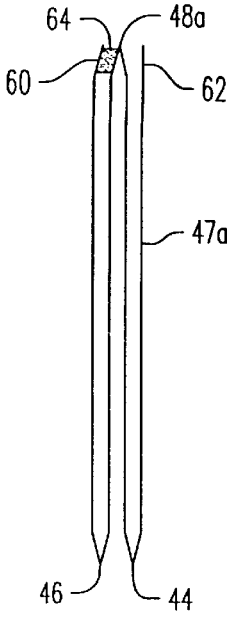
FIGS. 5*a* to 5*c* are end elevation schematic views of alternate embodiments of folded signatures in accordance with the present invention.
Figure 5B:
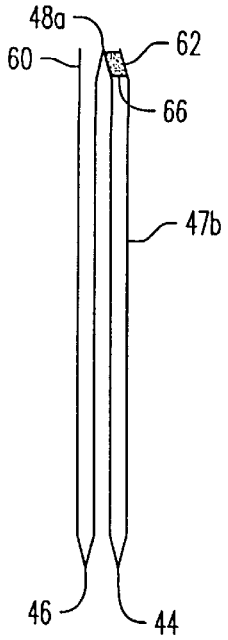
Figure 5C:
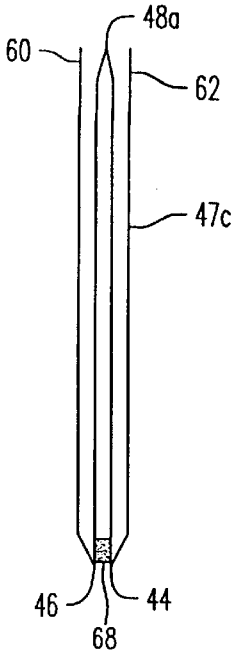

In this preferred three folded signature 47, referring to FIG. 5, three alternative modes of moistening adhesion or gluing are provided, afford an additional pulling edge for use during subsequent movement of the signature in final book binding operations. In FIG. 5*a*, the threefold signature 47*a* is adhered along perforated fold 48*a* and side margin 60 at 64. In FIG. 5*b*, the three-folded signature 47 is adhered along central perforated folds 48*a* and the opposite side margin 62 at 66. In FIG. 5*c*, the two outer perforated folds 44 and 46 are adhered together at 68*a* to form signature 47*c*. Again, each of these additional adhered or glued perforated margins provide one additional pulling margin in a four folded signature 52 shown in FIG. 4. Moreover, where only three signature folds are needed, one of the alternative perforation adhesions at 64, 66, or 68 provides the only means for pulling such a three folded signature.

Figure 6:
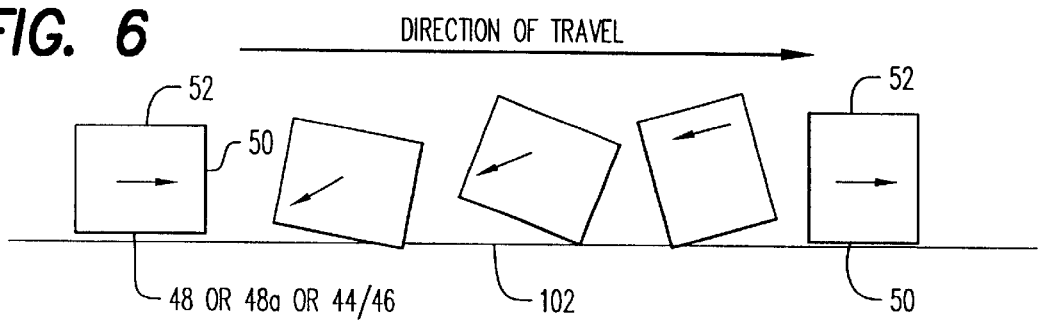
FIGS. 6 and 7 are side elevation schematic views of alternate modes of reorienting assembled signatures in preparation for final binding.
Figure 7:
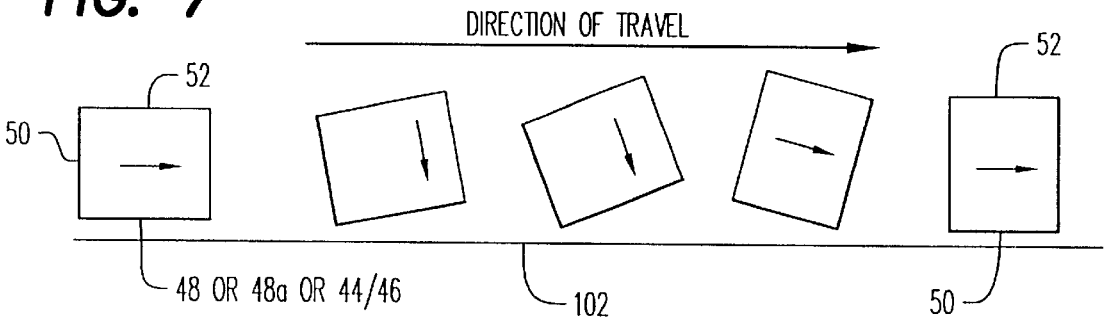

In FIGS. 6 and 7, another unique benefit of the present invention is there shown in terms of the options for orienting the assembled signatures shown for convenience at 52. These operations downstream of gathering require, on conventional existing equipment, that the assembled signatures be positioned so that backbone preparation can take place. This position requires that the binding edge 48 or 48*a* or 44/46 of the folded signatures 52 be turned to either a forwardly or a rearwardly orientation, depending upon the particular existing binding equipment 102 chosen by pulling on pulling edge 50. Thus, utilizing the improved folded signature structure of the present invention, the gathered signatures may be rotated in either direction, regardless of equipment chosen or available in the process of effecting binding. Note that the additional pulling edge created by the glued margins at 64, 66 or 68 provide more versatility in this stage of book binding.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A method of folding a continuous web of paper to be used for making signatures each having preprinted indicia on at least one surface thereof defining separate uniformly spaced regions or zones of said signature, comprising the steps of:

A. perforating and folding said web lengthwise thereto along one quarter of a width of said web from each side margin thereof to define first and second parallel fold lines which establish a binding edge adapted for enhanced adhesive penetration;

said first and second fold lines positioned at one quarter of a width from each side margin of each said web, said first and second folds made in the same direction with respect to a surface of said signature;

B. perforating and folding said web lengthwise thereto halfway between each said side margin to define a third fold line;

said third fold line positioned parallel to, and evenly spaced between, said first and second fold lines, said third fold being made in an opposite direction from that of said first and second fold lines;

C. adhesively attaching said first and second fold lines together and/or said third fold line and one said side margin together to define a binding or a pulling edge of a thrice folded said signature.

2. The method of claim 1, wherein:

said adhering step is accomplished by applying a narrow line of water along a corresponding said fold line causing a coating material on each said signature to self-adhere to a corresponding mating surface thereof;

said adhering step being accomplished substantially immediately following said perforating and folding step.

3. An apparatus for folding a continuous web of printing paper to be used for making signatures having preprinted indicia on at least one surface thereof defining separate uniformly spaced regions or zones of each said signature, comprising:

means for perforating and folding said web lengthwise along at one quarter of a width of said web from each side margin thereof in accordance with spaced regions or zones of said printed indicia to define first and second parallel fold lines which establish a binding edge adapted for enhanced adhesive penetration;

said first and second fold lines positioned at one quarter of a width from each side margin of each said web, said first and second folds made in the same direction with respect to a surface of said signature;

means for perforating and folding said web lengthwise thereto halfway between each said side margin along said length of a third fold line;

said third fold line positioned parallel to, and evenly spaced between, said first and second fold lines, said third fold being made in an opposite direction from that of said first and second fold lines;

means for adhering said first and second fold lines and/or said third fold line and one said side margin together to define a binding or a pulling edge of a thrice folded said signature.

4. The apparatus of claim 3, further comprising:

means for applying a narrow line of water along a corresponding said fold line causing a coating material on each said signature to self-adhere to a corresponding mating surface thereof;

said means for applying positioned to be accomplished substantially immediately following said perforating and folding step.

* * * * *